United States Patent [19]

Munsch et al.

[11] 4,171,122

[45] Oct. 16, 1979

[54] TENSIBLE REINFORCEMENT BAR FOR SHIPPING CONTAINERS

[75] Inventors: Charles Munsch, Bronx; John M. DiMartino, Sayville, both of N.Y.

[73] Assignee: Line Fast Corporation, Holbrook, N.Y.

[21] Appl. No.: 953,426

[22] Filed: Oct. 23, 1978

[51] Int. Cl.[2] ..... B66F 3/08

[52] U.S. Cl. ..... 254/67

[58] Field of Search ..... 269/112, 118, 41, 254 R; 403/43-44; 254/67; 24/68 CD, 68 D, 68 CT

[56] References Cited

U.S. PATENT DOCUMENTS

| | | | |
|---|---|---|---|
| 865,623 | 9/1907 | Wood | 269/254 R |
| 3,648,973 | 3/1972 | Farrell | 254/67 |

*Primary Examiner*—Robert C. Watson

*Attorney, Agent, or Firm*—Robert A. Kelly

[57] ABSTRACT

A tensible shipping container reinforcement bar having connectors on each end thereof the ends adapted to attach to diagonally opposite corner fittings of shipping containers. The bar having a compressor device capable of expansion located at a point intermediate in the bar so that when the ends of the bar are attached to diagonally opposite corners, the bar is expanded under tension. The bar is designed to prevent warping of the walls and end of the shipping containers when containers are subjected to high stress forces placed on them due to motion of containers in shipping, especially in ships. In a preferred embodiment the bar includes a device for adjusting the degree of tension provided by the bar.

13 Claims, 9 Drawing Figures

TENSIBLE REINFORCEMENT BAR FOR SHIPPING CONTAINERS

BACKGROUND OF THE INVENTION

In recent years the use of shipping containers has virtually revolutionized the freight handling industry, especially for international shipments, because of the convenience and economic advantages accruing from the use of weather-proof containers of rectangular shape which are capable of storing a number of unit items, where the packages of material, while confining and protecting the contents from loss or damage during transport as a unitary load, can be separated from the means of transport and trans-shipped without rehandling the contents.

In this connection, standardized containers (I.S.O. STANDARD) are standardized handling equipment have been developed concurrently to reap the maximum benefit from this development. Large numbers of now I.S.O. Standard Shipping Containers having a corner fitting at each corner thereof similar in general nature to that found in the I.S.O. Standard Shipping Containers. Some of these containers consist merely of frames having corner fittings mounted upon the corners of the frame. The corner fittings in most cases have orifices on the three outside faces thereof and the corner fittings are firmly attached to the body of the container. The function of the corner fitting is to provide an easily engageable reinforced means for connecting the containers to cranes, hoists, lashing devices and the like.

At this state, there is a world wide body of carriers, shippers, leasing companies, repair facilities, and manufacturers who are involved in the international intermodal transportation systems and who have an economic stake in assuring that the containers transported or serviced by them should be in compliance with the established standarads. These standards are based upon a container of forty foot length and having an end face approximately eight foot by eight foot and provide for use of shorter modules which can be arranged to occupy the space provided for a forty foot container in the hold of a ship or other intermodal transport.

As is well known in the arts, standard shipping containers or the type described have at each corner a corner fitting in which there is an orifice in each exterior face, each orifice opening into a common recess within the corner fitting. Many ships have been specifically adapted to carry containers. In the holds of these ships cells have been equipped and formed by a series of posts and the like wherein four rails have been created which are adapted to receive the corners of the containers which are forty feet long. In practice an average tolerance of 1½ inches fore and aft and 1 inch athwart ships is incorporated in the cell so that the placement of the grooves of the cell permit ease of entry and removal of containers from the cell and the use of containers which are warped slightly dimensionally. The tolerance also permits lashing of containers to the deck of the hold of the ship. The containers are linked to each other vertically upon loading.

Ships loaded with containers stacked on top of each other in cells or lashed on deck, encounter problems when they sail on rough seas. The roll of the ship causes a column of containers vertically stacked in the hold thereof to be pressured by severe lateral inertial forces. I.S.O. and I.S.O. Type shipping containers are designed to withstand a lateral inertial force on the top end thereof of about 33,600 pounds without warping the container. However, experience has shown that containers are subjected to forces greatly in excess of that amount in actual use conditions on rough seas. These excesive forces have created severe damage to containers by warping the shape thereof and in some cases damage to the ships.

To overcome this problem, uses have resorted to lashing the individual containers in the stack to the deck. This solution is very difficult to achieve because the distances between the containers when set in position is very small. This makes the use of complex lashings and deck fittings mandatory. For example, in a area adapted to receive forty foot long containers when nominal twenty foot long containers are used in place of a forty foot long container in the space the twenty foot long containers are approximately one and a half inches short of being twenty feet and a space of three inches exists between the two faces of the twenty foot long containers. This limited clearance between opposing container ends makes it very difficult to lash them down to the deck. Further, if they are the top layer of a stack of containers five containers deep the lashing is over forty feet from the container top to the deck. Thus making if very hard to reinforce the container against damage caused by lateral inertial forces which are applied to the top of the container by the rolling motion of the ship.

SUMMARY OF THE INVENTION

These and other drawbacks and disadvantages of the use of the standard shipping container on ships as well as in other modes of transportation are substantially reduced in accordance with the present invention whereby a tensible shipping container reinforcement bar capable of reinforcing the rigidity of an I.S.O. standard and I.S.O. Type shipping container when attached thereto, said container having a corner fitting at each of the corners thereof and each of said fittings having orifices on each of the external faces thereof said orifices being surrounded by a wall surface and said orifices opening into recess there behind, wherein the bar has a connector means mounted on one end of said bar capable of grasping the wall surrounding an upper orifice of a container and a second connector means mounted on the opposite end of said bar capable of removable engagement with the wall surrounding a lower, a diagonally opposed lower orifice of a lower corner fitting of a said container. The bar further contains tensioning means mounted intermediate to the connector means on the bar capable of exerting a compressive tension on said bar when the bar is mounted across the face of a side of a container having its connector means engaged with the respective orifices of the container. According to the practice of this invention, our horizontal connector can comprise either a one part body in which the connector means are an integral portion of the bar and the tensioning means can be a warping of the shape of the bar and device can be made of several parts with connecting means mounted on a straight bar with the tensioning means being either an integral portion of the bar or a tensioning means mounted on the bar such as a spring placed at an intermediate position on the bar. In a preferred embodiment of our invention we employ a separate device such as a turn-buckle to allow for adjusting the length of the bar which also in effect allows the tension of the bar to be adjusted.

A more thorough and complete understanding of the invention may be had by reference to the appended drawings together with the description of the preferred embodiment.

DESCRIPTION OF THE PREFERRED EMBODIMENT

Figure 1:
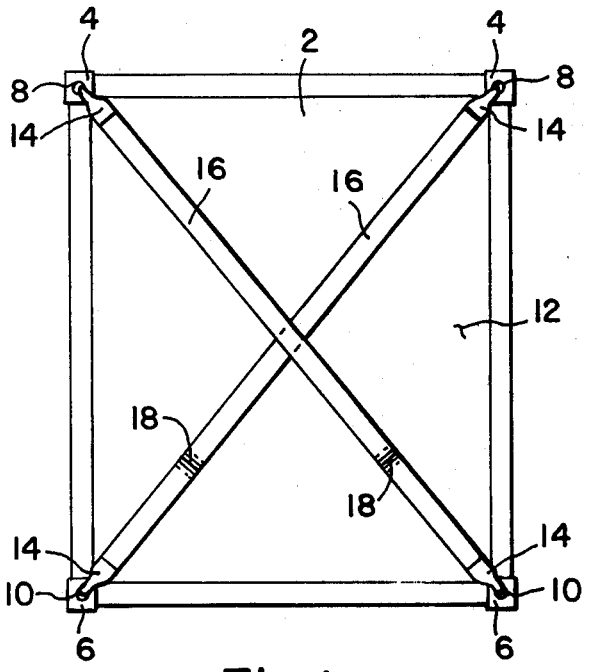
FIG. 1 is an end view of an I.S.O. or non I.S.O. shipping container having two reinforcement bars mounted diagonally upon one end of the shipping container.
Figure 2:
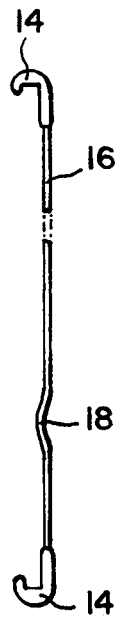
FIG. 2 is a side view of the embodiment of a reinforcement bar as shown in FIG. 1.

In the drawing wherein the numerals refer to like components FIGS. 1 and 2 illustrate a first embodiment of my invention wherein an end of an I.S.O. shipping container 2 having upper corner fittings 4 on each side of the container and lower corner fittings 6 on each side of the container. Orifices 8 in the upper corner fittings 4 have inserted therein a connecting means 14 which is a hook engaged therein and connected to the walls surrounding the orifice of corner fitting 4. On the other end of reinforcement bar 16 is a connecting means 14 which enters through orifice 10 of corner fitting 6 and is in engagement with the wall surrounding orifice 10. The FIG. 1 shows two reinforcement bars 16 which are mounted diagonally between the diagonally opposed corner fittings 4 and 6 and run across the face 12 of shipping containers 2.

The use of the term I.S.O. Standard Shipping Container as used in this description is meant to include all shipping containers which have corner fittings similar to nature if not in detail to the I.S.O. Standard Shipping Container, as the principals disclosed herein are applicable to all such containers. Thus, for the sake of definition we have used the term I.S.O. Type Standard Shipping Container to encompass both I.S.O. shipping containers and other types of shipping containers in general which have corner fittings at each corner thereof, said corner fittings having orifices in the external faces thereof, and which conform generally structurally with I.S.O. shipping containers. These containers need not have walls, etc. but can also consist of frames having corner fittings mounted therein.

Tensioning means 18 as shown in FIGS. 1 and 2 consists of a curve in the body of reinforcement bar 16 as tension is placed on the bar to expand the length of bar 16 the curvature of tensioning means 18 tends to straighten out into a straight line. Tensioning means 18 of course could be replaced by any other of common tensioning devices such as spring etc. The tensioning means 18, of course, must deliver a compression tension between the hooks 14 which are at the opposite ends of reinforcement bar 16. In operation, as the top side of container 2 attempts to move parallel with respect to the bottom side of container 2, the diagonal lengths between the cross bars 16 will vary depending upon the direction of the lateral movement of the container. The respective reinforcement bars 16 as shown in FIG. 1 will increase or decrease in length.

The bars 16 may be affixed to the container 2 by forcibly inserting the hooks into the orifices. In order to avoid having the reinforcement bars accidentally release from the container when there is a displacement in vertical alignment between the top side of the container with respect to the bottom side of the container we employ in our preferred embodiment of the invention a tensioning means 18 such as that shown in FIG. 2 and/or FIGS. 8 and 9 wherein the reinforcement bar 16 is installed while it is under tension. The degree of tension in the reinforcement bar 16 being approximately half the amount of tension and expansion of bar 16 that is provided by tensioning means 18. In this respect the bar is caused to extend to its maximum extension due to a straightening out of the curvature of tensioning means 18 and the elasticity inherent in such a reinforcement bar 16 must be taken into account. The shortening of the opposite diagonal bar will be compensated for by the pre-tensioning and thus prevent the bar from being released from its intended position.

Figure 8:
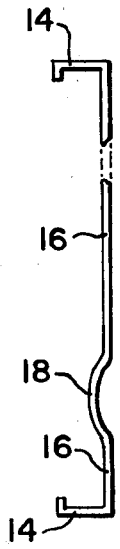
FIG. 8 is a side view of a one piece reinforcement bar in accordance with the practice of this invention having retainer clips.
Figure 9:
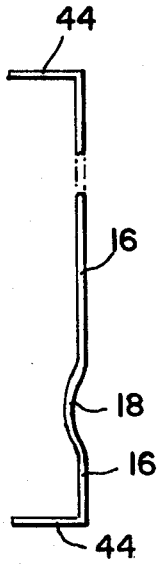
FIG. 9 is a side view of a one piece reinforcement bar in accordance with the practice of this invention without retainer clips.

The connection hooks 14 can be affixed to bar 16 by welding, bolting, or any other conventional means. In FIG. 8 and FIG. 9 the connecting means 14 and 44 are an integral portion of reinforcement bar 16 can be made simply by making permanent bends in the end of the bar as shown in the drawings. The term, connecting means 14 as used in this invention merely means for grasping or connecting the ends of the reinforcement bar 16 on to the side wall of an orifice of a corner fitting of a container. It can simply be a projection 14 extending perpendicularly from bar 16 as shown in FIG. 9 or it can have an additional bend forming a hook 14 as shown in FIG. 8.

Figure 3:
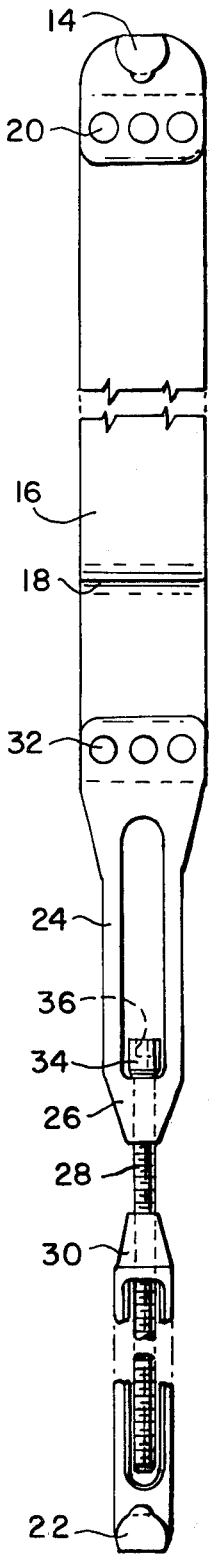
FIG. 3 is a front view of a apparatus in accordance with the practices of this invention having a turn-buckle type length adjustment incorporated into the bar comprising a portion of a reinforcement bar permitting the bar to have adjustment of its length and selective tensioning of the reinforcement bar.
Figure 4:
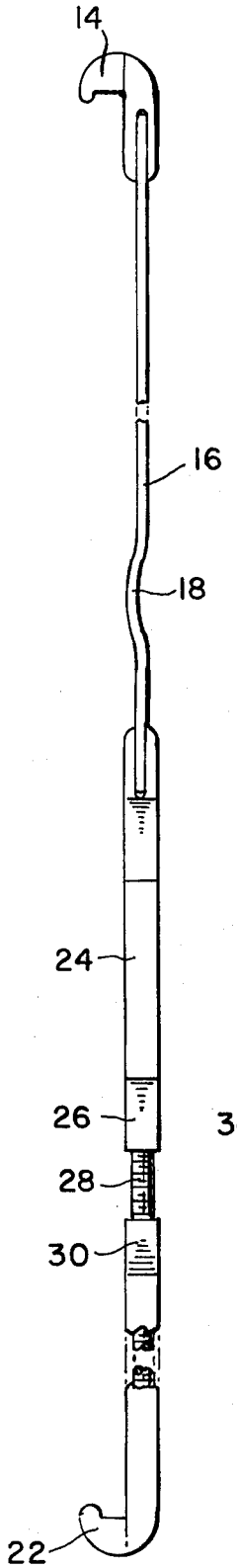
FIG. 4 is a side view of FIG. 3.

Materials of fabrication for the reinforcement bars 16 as shown and illustrated in this invention can be chosen from spring steel and can be rod-like or a flat band of steel. The reinforcement bars of this invention can also be an assembly of several individual components as shown in FIG. 3 showing a front view of a preferred embodiment of a reinforcement bar 16 as constructed in accordance with the reachings of our invention. The bar shown in FIG. 3 has a mechanical bar length adjustment means shown as a portion of the reinforcement bar 16 as shown in FIG. 3. The mechanical bar length adjustment means 28 as shown in FIG. 3 consists of a threaded rod adapted to be received into two metal sleeves 26 and 30. Said sleeves having internal threads arranged so as to enable overall adjustment of the length thereof and said sleeves being shown as being fastened onto the reinforcement bar 16 by bolts 32. The mechanical bar length adjustment means 28 is received into the two metal sleeves 26 and 30 and functions by rotating the mechanical bar lengthening means 28 within the sleeves 26 and 30. The mechanical bar lengthening means as shown in the figure is a turn-buckle type device. It would be obvious to anyone skilled in the art to substitute a conventional turn-buckle type device for the turn-buckle type device as shown in FIGS. 3 and 4.

Figure 7:
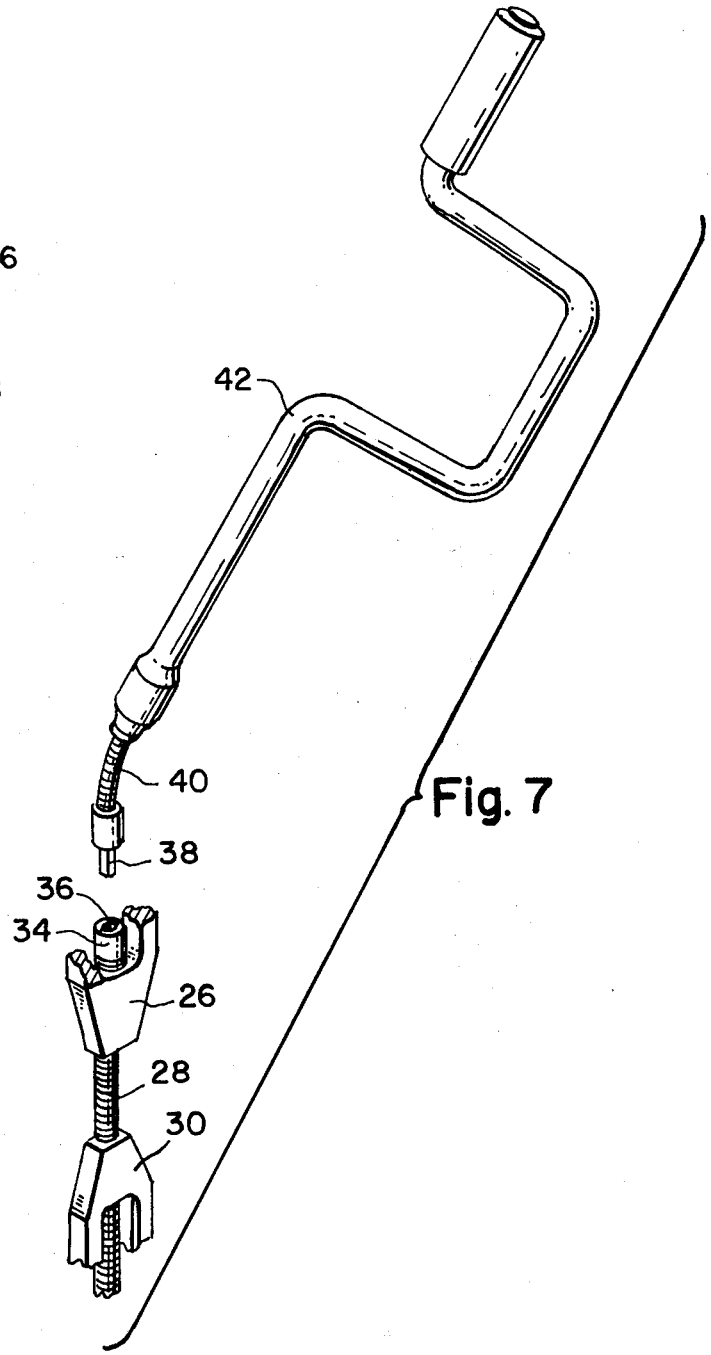
FIG. 7 is an enlarged detail of a portion of FIG. 3 showing a mechanical device for adjusting the lengths of the bar. It also shows a crank device with a flexible coupling and a means for attaching the crank device to the apparatus for adjusting the length of the bar.
Figure 6:
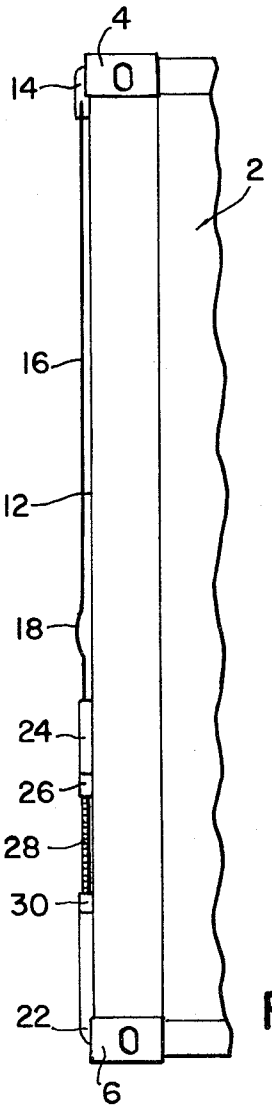
FIG. 6 is a side view cutaway of an I.S.O. shipping container having a reinforcement bar as shown in FIG. 3 mounted thereon at one end.
Figure 5:
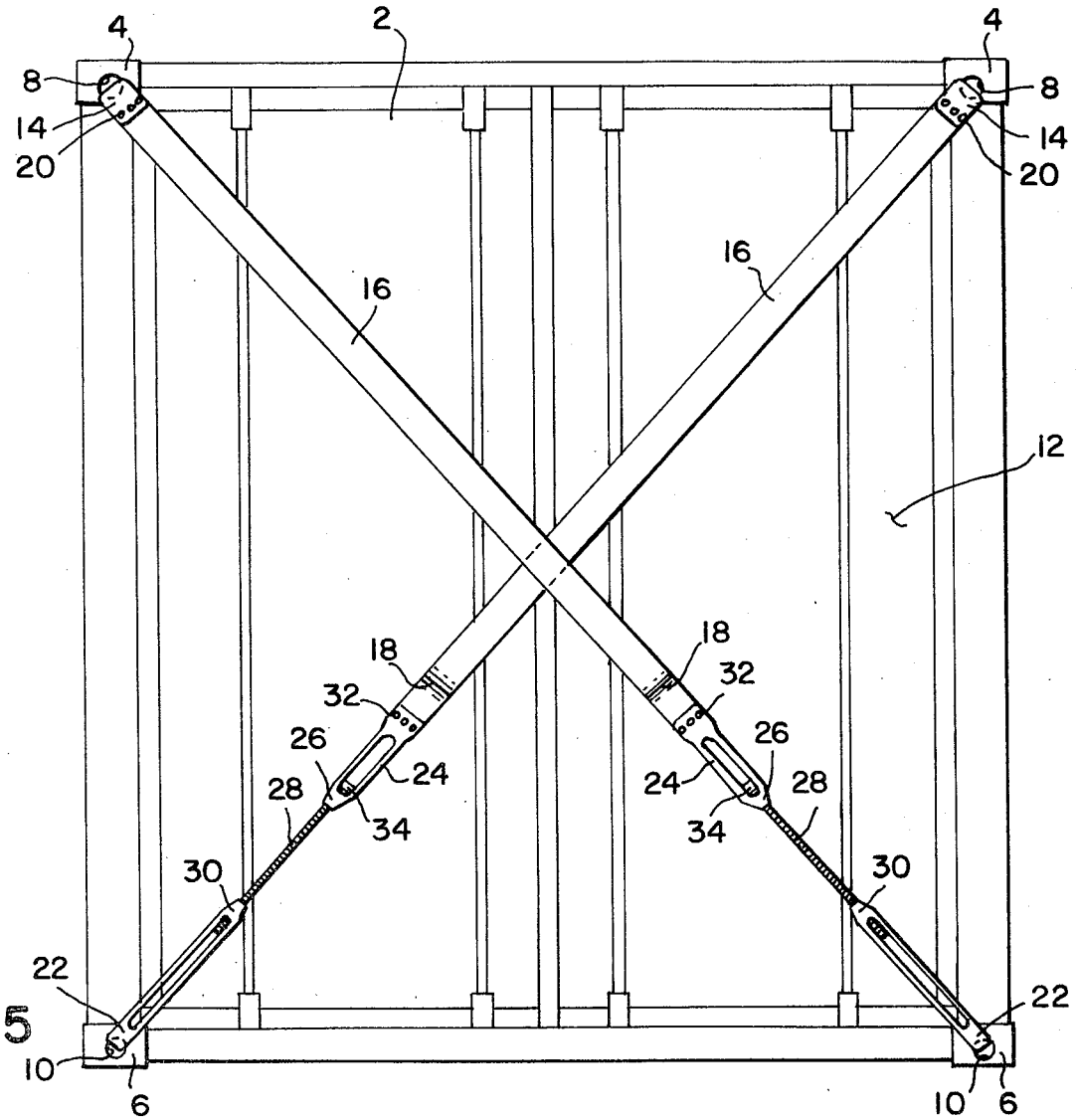
FIG. 5 is an end view of an I.S.O. shipping container having two reinforcement bars constructed in accordance with FIG. 3 mounted diagonally thereon.

FIG. 7 shows a cutaway expanded view of the mechanical bar lengthening device 28 together with the sleeves 26 and 30 having the opposite opposed threads. In FIG. 7, a female socket 36 is shown with additionally there being shown separately a crank handle device 42 having a flexible drive shaft 40 and a male socket head 38 for insertion into the female socket receptacle 36 so that the mechanical bar lengthening device can adjust the distance between the metal sleeve, 26 and the metal sleeve 30 by rotating the mechanical bar lengthening device 28. The use of this mechanical bar lengthening device allows for the reinforcement bar 16 to be easily coupled to the shipping container and further allows for an adjustable degree of tensioning pressure to be put on the reinforcement bar 16 so as to be adjusted to the desired degree of pressure. Users of the device disclosed in this invention, of course, can couple the crank 42 as shown in FIG. 7 torque gauges, or any other type gauges which will allow a quick readout of the degree of tension on the reinforcement bar 16 when it is coupled to a shipping container 2.

Users of the device as shown in this invention will also be able to lock the two bars in position to add additional security to prevent the ends of the container from opening accidentally. In the preferred embodiment of our invention we would apply a lock to where the two reinforcement bars 18 as shown in FIG. 1 cross. Use of such a lock will assist in preventing either of the bars from popping out due to the end of the container being warped laterally by inertial forces causing one diagonal to become shorter between the orifices and the other diagonal between the orifices of the end of the shipping container 2 to become longer. The reinforcement bar 18 which is becoming extended due to the additional length it is gaining because of the inertial pressure will become more tightly gripped on the container and if both of these diagonally opposed bars are locked in with each other it will hold the bar which is becoming looser in place adding additional security to that reinforcement bar 18. Further, since most shipping containers open on the ends thereof the use of our novel reinforcement bars will tend to hold the doors shut in case they are accidentally jolted or a lock failure on the end of the container.

In a further embodiment of our invention the lateral bar length adjustment means 28 as shown in FIG. 3 can be simply a common turn-buckle with both bolts commonly found in the ordinary turn-buckle being bolted at one end to each end of the reinforcement bar and the threaded link connecting both bolts being attached to each bolt. The threads, of course on such an arrangement would be arranged so that when the turn-buckle was turned one way the reinforcement bar 18 would be shortened and when the rotation of the turn-buckle was turned the other way the length of the bar would be expanded.

The mechanical length adjustment means 18 as shown in FIG. 3 can be of a type which provided for the change in length on the bar to be in a continuous non-incremental mode such as that shown by the turn-buckle type mechanical bar lengthening adjustment means 18 as shown in FIG. 3. Further, it would be obvious to substitute for the mechanical bar length adjustment means 18 shown in FIG. 3 a jackbar device wherein the mechanical bar length adjustment means adjusts the changes in length in the reinforcement bar 16 in an incremental mode. The use of such mechanical length adjustment provides that very high degree of compressive forces can be applied between the corner fittings found on the ends of a shipping container. The use of a jackbar type mechanical bar length adjustment means would permit such bars to be used to realign containers which have been warped out of proper alignment simply by applying sufficient pressure to forcibly pull such a warped container back into a trued-up alignment. This is another advantage to be contained by users of our novel invention.

The spring tension means 18 provides for a gradual absorption of the inertial forces developed by the motion of containers in transit. This gradual absorption reduces the impace of the inertial forces. Further, the reinforcement bar can be constructed to allow a predetermined limit of container deformation and thus prevents costly damage to containers and contents thereof as well as to adjacent containers, the carrying vehicle and personnel.

In the preferred embodiment of our invention, the tension on the reinforcement bar 18 is adjusted so that the bar achieves its full restraining power when the upper and lower faces of the containers are displaced one and one half inches with respect to each other. The reinforcement bars of this invention having mechanical bar lengthening means incorporated therein can be used to return containers which have been warped dimensionally out of shape back into proper alignment by using the bars to pull the container back into its proper shape.

It will be obvious to those skilled in the art that the novel devices disclosed herein can be used to advantage as reinforcement bars for sides, ends, tops and bottoms of the container. Further, when two reinforcement bars of this invention are criss-crossed across the face of a container, said reinforcement bars can be locked together at the point of crossover by a conventional locking means to provide additional security.

It would be within the scope of this invention to utilize V-shape reinforcement bars designed whereby the connector means of an individual bar would be mounted in an upper and lower corner fitting which are non-diagonal with respect to each other, and connecting a second similar V-shaped bar on the opposite corners and providing an adjustable tensioning means connecting the crotches of the two bars. Other arrangements and type of bars useable in this invention will be obvious to those skilled in the art.

What is claimed is:

1. A tensible shipping container reinforcement bar capable of reinforcing the faces of an I.S.O. Type Standard Shipping Container when attached thereto, said container having corner fitting at each of the corners thereof, each said fitting having orifices on each of the external faces thereof, said orifices being surrounded by a wall surface and said orifices opening into a recess therebeing, said bar comprising:

a first bar having a first end and a second end;

a first connector means mounted on the first end of said first bar capable of removeable engagement with the wall surrounding the orifice of an upper corner fitting of said container;

a second connector means mounted on the second end of said first bar capable of removeable engagement with the wall surrounding the orifice of a lower corner fitting of said container;

tensioning means mounted on said first bar at a point which is intermediate to the first and second connector means mounted on said first bar is mounted across the face of a side of a container having the first connector in engagement with an upper corner fitting of the container and the second connector in engagement with a lower corner fitting of the container;

said bar being adapted to being mounted diagonally across the face of the container and when so mounted extends less than one and one half inches from the face of the container upon which it is mounted;

cross over means on said bar adapted to permit a second bar similarly constructed as said first bar capable of being mounted on said container face cross-wise with respect to said first bar, said first bar and said second bar are so configured that the thickness of both said bars at the point of crossover extends less than one and one half inches from the surface of the container upon which they are mounted.

2. The reinforcement bar of claim 1 wherein said tensioning means is composed of a section of spring steel having at least one curve therein, said section of spring steel forming a portion of the bar, located intermediate between the first and second connectors.

3. The reinforcement bar of claim 1 wherein said tensioning means is a compression spring forming a portion of the bar located intermediate between the first connector and the second connector.

4. The reinforcement bar of claim 1 wherein said bar is composed of one piece of metal.

5. The reinforcement bar of claim 1 wherein the first and second connector means are each composed of a hook adapted to engage the walls of the orifices of the respective corner fittings into which they are being coupled.

6. The reinforcement bar of claim 1 wherein the first and second connector means are each composed of a section of the bar projecting perpendicularly from the bar.

7. A tensible shipping container reinforcement bar capable of reinforcing the faces of an I.S.O. Type Standard Shipping Container when attached thereto, said container having a corner fitting at each of the corners thereof, each said fitting having orifices on each of the external faces thereof, said orifices being surrounded by a wall surface and said orifices opening into a recess therebehind, said bar comprising:

a first bar having a first end and a second end;

a first connector means mounted on the first end of said first bar capable of removeable engagement with the wall surrounding the orifice of an upper corner fitting of said container;

a second connector means mounted on the second end of said first bar capable of removeable engagement with the wall surrounding the orifice of a lower corner fitting of said container;

tensioning means mounted on said first bar at a point which is intermediate to the first and second connector means mounted on said first bar capable of exerting a compressive tension on said bar when said bar is mounted across the face of a side of a container having the first connector in engagement with an upper corner fitting of the container and the second connector in engagement with a lower corner fitting of the container;

the mechanical means incorporated into said bar for adjusting the length of said bar;

said bar being adapted to being mounted diagonally across the face of the container and when so mounted extends less than one and one half inches from the face of the container upon which it is mounted;

cross over means on said bar adapted to permit a second bar similarly constructed as said first bar capable of being mounted on said container face cross-wise with respect to said first bar, said first bar and said second bar are so configured that the thickness of both said bars at the point of crossover extends less than one and one half inches from the surface of the container upon which they are mounted.

8. The reinforcement bar of claim 7 wherein said mechanical bar length adjustment means makes such changes in length in an incremental mode.

9. The reinforcement bar of claim 7 wherein said mechanical bar length adjustment means makes such changes in length in a continuous non-incremental mode.

10. The reinforcement bar of claim 9 wherein the tensioning means is composed of a section of spring steel having at least one curve therein, said section of spring steel forming a portion of the bar, located intermediate between the first and second connectors.

11. The reinforcement bar of claim 7 wherein the first and second connector means are each composed of a hook adapted to engage the walls of the orifices of the respective corner fittings into which they are being coupled.

12. The reinforcement bar of claim 7 wherein said mechanical bar length adjustment means is a jack bar.

13. The reinforcement bar of claim 7 wherein said tensioning means is a compression spring forming a portion of the bar located intermediate between the first connector and the second connector.

* * * * *